United States Patent [19]

Schoch

[11] Patent Number: 4,472,611

[45] Date of Patent: Sep. 18, 1984

[54] CURRENT SUPPLY CONNECTOR COMPRISING A PLUG SOCKET WITH PIVOTAL CONTACT-STRIPS AND A PLUG WITH A PUSH-ROD UNIT

[75] Inventor: Charles Schoch, Appenweir, Fed. Rep. of Germany

[73] Assignee: Societe d'Exploitation des Procedes Marechal (SEPM), Paris, France

[21] Appl. No.: 438,295

[22] Filed: Nov. 1, 1982

[30] Foreign Application Priority Data

Dec. 21, 1981 [FR] France ..... 81 23802

[51] Int. Cl.[3] ..... H01R 13/70

[52] U.S. Cl. ..... 200/51 R; 200/51.03

[58] Field of Search ..... 200/51 R, 51.02, 51.03–51.07, 200/51.08–51.11, 51.13, 50 B, 329; 339/75 R, 73 M

[56] References Cited

U.S. PATENT DOCUMENTS

| | | | |
|---|---|---|---|
| 2,986,612 | 5/1961 | Healy | 200/51 R |
| 4,008,382 | 2/1977 | De Rosa | 200/51 R |
| 4,185,881 | 1/1980 | Foley et al. | 200/51.07 X |
| 4,249,787 | 2/1981 | Welo | 339/64 R |

FOREIGN PATENT DOCUMENTS

| | | | |
|---|---|---|---|
| 2418634 | 10/1975 | Fed. Rep. of Germany | 200/51 R |
| 2466111 | 3/1981 | France . | |

*Primary Examiner*—Stephen Marcus
*Assistant Examiner*—Ernest G. Cusick
*Attorney, Agent, or Firm*—Sandler & Greenblum

[57] ABSTRACT

In a high-current connector, a plug and plug socket are provided with means for relative locking in a position in which at least one contact-pin of the plug and/or of the plug socket is located opposite to the corresponding contact-strips but without touching them.

18 Claims, 6 Drawing Figures

CURRENT SUPPLY CONNECTOR COMPRISING A PLUG SOCKET WITH PIVOTAL CONTACT-STRIPS AND A PLUG WITH A PUSH-ROD UNIT

BACKGROUND OF THE INVENTION

1. Field of the Invention

This invention relates to a current supply connector comprising a plug socket having pivotal contact-strips as well as to a plug having a push-rod unit, said connector being primarily intended for operation at high current intensities.

2. Description of Prior Art

As disclosed in U.S. Pat. No. 4,249,787, it is already known to construct a connecting device providing end contact pressure and especially a current supply connector comprising a socket and detachable plug each provided with at least one contact-pin, thus forming at least one pair of pins to be placed in contact with each other.

In one device of the type described in the patent cited above, each pair of contact-pins is provided with at least one contact-strip of conductive material. Provision is made on each contact-strip face for at least one protuberance in the form of a boss or contact-stud which is intended to bear on the end face of one contact-pin of said pair when the plug and the socket are in the connection position. Each contact-strip is pivotally actuated by at least one spring which is retained by fixing or keying at one end on a component or element of the plug socket in such a manner as to ensure that each contact-stud of each contact-strip is urged towards its corresponding contact-pin.

A device of this type makes it possible in particular to obtain all the advantages of contacts applied endwise under pressure.

It is in fact a known principle established by a physical law that contact resistances can be determined by an inverse function of the contact force, which explains the attractive character of all end contacts on which a pressure can be exerted with a view at achieving more efficient flow of current.

Furthermore, this device circumvents the disadvantages arising from the conductive braided-wire elements which are usually employed in end contact devices. For example, disadvantages appear at the level of connections and are also present in the fabrication of braided wires.

However, the embodiments described in the patent cited earlier do not propose any particular means for interlocking the plug and socket or any particular connection operation. By way of example, the cited patent is more especially concerned with a bayonet-type attachment for a single-wire connection in which relative locking of the plug and socket as well as contact-making are both achieved at the same time by the plug-inserting operation.

In the high-current connectors employed in industry or in harbor installations, for example, the connecting cables of the detachable plug necessarily have large cross-sectional areas which make it fairly difficult to handle the plug. It is therefore an advantage to reduce the relative movements of the plug and of the plug socket and to facilitate the contact-making operation which often entails the need to exert a considerable effort.

This problem is solved by means of the device described in French Pat. No. FR 2466111, for example. This patent proposes a current supply connector in which the plug and the plug socket are first locked in position with respect to each other, an electrical contact being then made by means of a plug thrust member so arranged that the movable contact-pins mounted in the plug are thrust towards the socket contacts.

An arrangement of this type also offers further advantages such as, for example, perfect sliding motion of the movable contacts of the plug independently of the sliding motion of the plug and plug socket. The result thereby achieved is that a quick break can be obtained by suitable means without any attendant danger of jamming. Furthermore, the plug can be fitted within the plug socket practically without play and in a relatively fluid-tight manner, which is particularly advantageous in inflammable or explosive environments.

It proves necessary in this device, however, to provide movable contact-pins entailing the use of conductive braided-wire elements which are subject to drawbacks in comparison with the strip-type contacts mentioned earlier.

SUMMARY OF THE INVENTION

The primary objective of the present invention is to propose a current supply connector providing end contact under pressure in which the plug and plug socket are each provided with at least one stationary contact-pin, each pair of contact-pins to be placed in contact with each other being fitted with at least one pivotal contact-strip of the type mentioned in the foregoing. Interlocking of the plug and plug socket can be relatively fluid-tight and the contacting operation is independent of the movement of the plug after insertion of this latter.

In order to achieve this objective, the connector in accordance with the invention is distinguished by the fact that the plug and the plug socket are provided with means for relative locking in a position in which at least one contact-pin of the plug and/or of the plug socket is located opposite to the corresponding contact-stud or studs of its contact-strip or strips but without touching them. Furthermore, the socket component or element which retains the spring or springs is mounted so as to be capable of displacement within said plug socket whilst a push-rod unit is movably mounted within the plug. Means adapted to project from said plug are provided for actuating said push-rod unit and causing said unit to exert a thrust on the movable element in such a manner as to increase the action of each spring and thus produce increased pivotal motion of each contact-strip until each contact-stud of said contact-strip is placed in contact under pressure with the corresponding contact-pin of the plug or of the plug socket.

In one embodiment, each contact-pin of the plug is displaced radially with respect to the corresponding contact-pin of the plug socket and each contact-strip has an extension to which is secured one end of each corresponding spring. In consequence, each contact-stud of one contact-strip face is applied on the end of the corresponding socket contact-pin, each contact-stud of the other contact-strip face being urged towards the corresponding contact-pin of the plug.

The distinctive feature of the aforementioned embodiment lies in the fact that the movable element to which is secured the other end of each spring is slidably mounted within the plug socket whilst said movable element is urged on the one hand in a continuous manner towards a rest position by a resilient restoring means and, on the other hand under the driving action of the push-rod unit, towards a connection position in opposition to the action of said restoring means.

An advantageous feature in this case lies in the fact that the movable element is slidably mounted within a central well of the plug socket and each spring is a pressure spring secured between the extension of the corresponding contact-strip or strips and a portion of the movable element. The result thereby achieved is that a longitudinal displacement of said movable element in sliding motion produced by the push-rod unit subjects said spring to an additional compression.

The invention is even more particularly concerned with a current supply connector fitted with an earthing contact and/or at least one pilot contact each provided in the same manner as the phase contacts with one pair of contact-pins and at least one contact-strip. The invention is characterized in that said earth and/or pilot contact strips have a shape and/or a position such that the contact-strips of the plug socket come into contact with the corresponding contact-pins of the plug and of the plug socket during actuation of the push-rod unit while complying with the order of earth-phase-pilot contact connection and, on the contrary, move away from the corresponding contact-pins of the plug and/or of the plug socket during a movement of the push-rod unit in the opposite direction while complying with the order of pilot-phase-earth contact separation.

Further embodiments of the invention comprise other means such as locking systems, means for actuating the push-rod unit, and so on.

More particularly, the apparatus in accordance with this invention comprises a current supply connector comprising a plug socket and a detachable plug each provided with at least one stationary contact-pin so as to form at least one pair of pins to be brought into contact with each other, each pair of contact-pins being provided with at least one contact-strip of conductive material, said contact-strip being provided on each face with at least one contact-stud which is intended to be applied against the end face of one of the contact-pins of said pair when the plug and plug socket are in the connection position, each contact-strip being displaced in pivotal motion by at least one spring which is retained by keying at one end thereof on a socket component in such a manner as to ensure that each contact-stud of each contact-strip is urged towards its corresponding contact-pin, characterized in that the plug and the plug socket are provided with means for relative locking in a position in which at least one contact-pin of the plug and/or of the plug socket is located opposite to the corresponding contact-stud of its contact-strip but without touching, and the socket component which retains at least one spring is movably mounted so as to be capable of displacement within said plug socket, and wherein means are provided to exert a thrust on the movable element in such a manner as to increase the action of each at least one spring and thus produce increased pivotal motion of each contact-strip until each contact-stud of said contact-strip is placed in contact under pressure with the corresponding contact-pin of the plug or of the plug socket, and wherein said means exerting said thrust includes a push-rod unit movably mounted within the plug, and means adapted to project from said plug are provided for actuating the push-rod unit and causing said unit to exert a thrust on the movable element.

Also, in accordance with the invention, each contact-pin of the plug is displaced radially with respect to the corresponding contact-pin of the plug socket and each contact-strip has an extension to which is secured one end of each corresponding spring so that each contact-stud of one contact-strip face is applied on the end of the corresponding socket contact-pin, each contact-stud of the other contact-strip face being urged towards the corresponding contact-pin of the plug, characterized in that the movable element to which is secured the other end of each spring is slidably mounted within the plug socket whilst said movable element is urged on the one hand in a continuous manner towards an inactive or rest position by a resilient restoring means and, on the other hand under the driving action of the push-rod unit, towards a connection position in opposition to the action of said restoring means.

Additionally, it is provided for the movable element to be slidably mounted within a central well of the plug socket and each spring is a pressure spring secured between the extension of the corresponding contact-strip and a portion of the movable element so that a longitudinal displacement of said movable element in sliding motion produced by the push-rod unit subjects said spring to an additional compression.

Additionally, the extension of each contact-strip is applied in the rest position against a portion of the movable element.

The invention is also characterized by the pushrod unit comprising a push-rod and a threaded portion in cooperating relation with a corresponding screw-thread of the plug whilst the push-rod actuating means is a hand-wheel which is rigidly fixed to the rod and projects from the plug.

The invention is also characterized by said connector being fitted with an earthing contact and/or at least one pilot contact each provided in the same manner as the phase contacts with one pair of contact-pins and at least one contact-strip, characterized in that said earth and/or pilot contact strips have a position such that the contact-strips of the plug socket come into contact with the corresponding contact-pins of the plug and of the plug socket during actuation of the push-rod unit for earth-phase-pilot contact connection and, move away from the corresponding contact-pins of the plug and/or of the plug socket during a movement of the push-rod unit in the opposite direction.

An additional feature of the invention is characterized by the plug being provided with means for locking said plug with respect to the plug socket, said locking means being controlled by the push-rod and the push-rod actuating means in that the locking means comprises a rod urged to an inactive position by a restoring spring, a ramp being formed on the push-rod in order to produce action on one end of the locking rod in such a manner as to ensure that actuation of the push-rod in the contact-making direction has the effect of causing the free end of the locking rod to project from the plug and to engage in a suitable recess of the plug socket, a reverse movement of the push-rod being such as to cause unlocking under the action of the locking-rod restoring spring.

Finally, the invention includes the movable element rigidly fixed to a rod which projects from the plug socket and is intended to actuate any device when the push-rod is actuated as said rod undergoes a displacement conjointly with said movable element.

BRIEF DESCRIPTION OF THE DRAWINGS

These and other features of the invention will be more apparent upon consideration of the following description relating to a particular embodiment which is given by way of example, reference being made to the accompanying drawings, wherein.

DETAILED DESCRIPTION OF THE INVENTION

Figure 2:
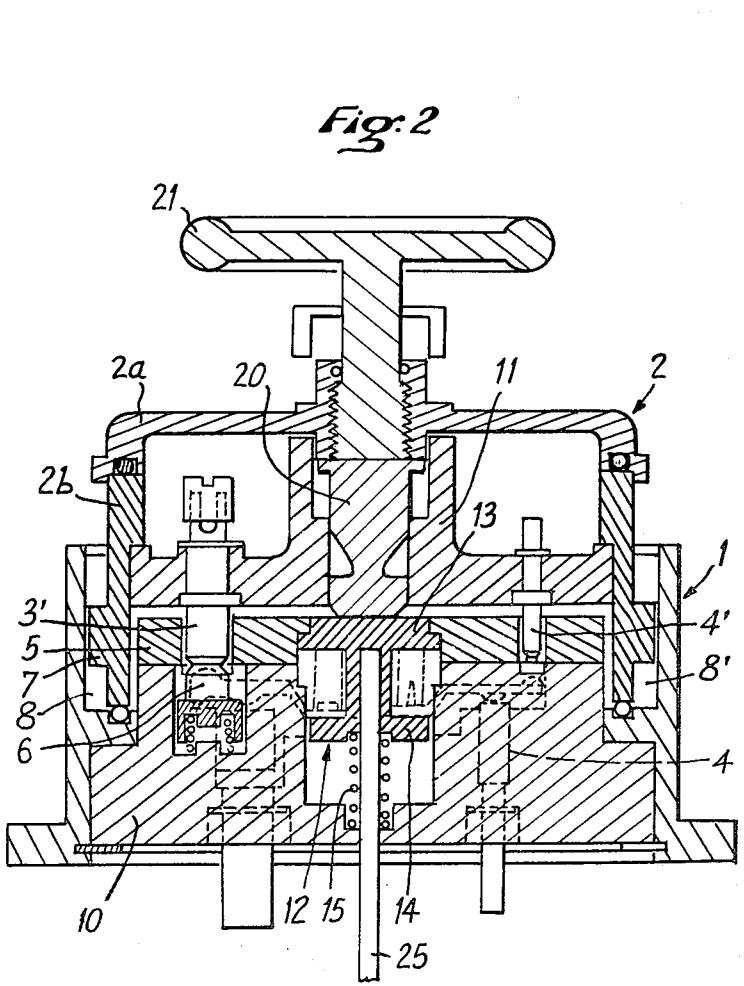
FIG. 2 shows the connector of FIG. 1 after insertion but prior to rotation of the plug within the plug socket.

The accompanying drawings show a current supply connector comprising a plug socket 1 which is usually stationarily mounted and supplied with current by connection cables (not shown) and a detachable plug 2 in two parts 2*a* and 2*b*, said plug being in turn connected to at least one cable extending to the appliance or equipment served. By way of example, the plug is elbowed in known manner. In other words, the connecting cable of said plug (not shown in the drawings) is connected in a plane which is substantially perpendicular to the plane of the drawings.

The plug socket and the plug are provided with a predetermined number of stationary contact-pins designated respectively by the reference numerals 3, 4 and 3', 4'. The number of contact-pins is clearly dependent on the nature of the current employed (single-phase, three-phase, and so on) and on the number of pilot contacts desired. The drawings show only two pairs of contact-pins but it is readily apparent that a greater number is usually provided in a connector of this type.

The socket contact-pins 3, 4 as shown in the drawings are respectively phase and pilot pins whereas the plug contact-pins 3', 4' correspond to the pins 3 and 4.

The contact-pins 3, 4 of the plug socket are arranged within an insulating body 10 and the corresponding contact-pins 3', 4' of the plug are arranged within an insulating body 11.

Figure 1:
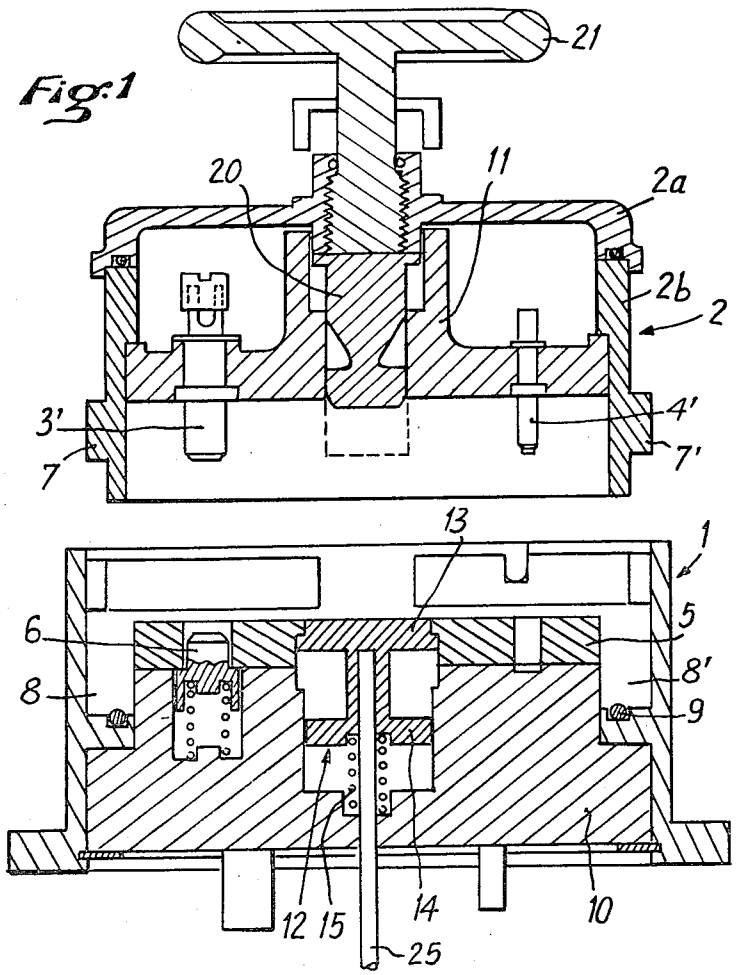
FIG. 1 is a part-sectional view of a connector in accordance with the invention and prior to plug insertion.

The plug socket 1 is provided in known manner with a safety disc 5 rotatably mounted on the insulating body 10 and with a retractable resilient locking-lug unit 6 for locking the disc (as shown in FIGS. 1 and 2). In the rest position, the disc 5 serves to protect the contact-strips and the contact-pins of the plug socket and is provided in addition with a number of openings corresponding to the number of pairs of contact-pins to be brought into contact. In addition, said openings are arranged in the same manner as the contact-pins of the plug.

Figure 4:
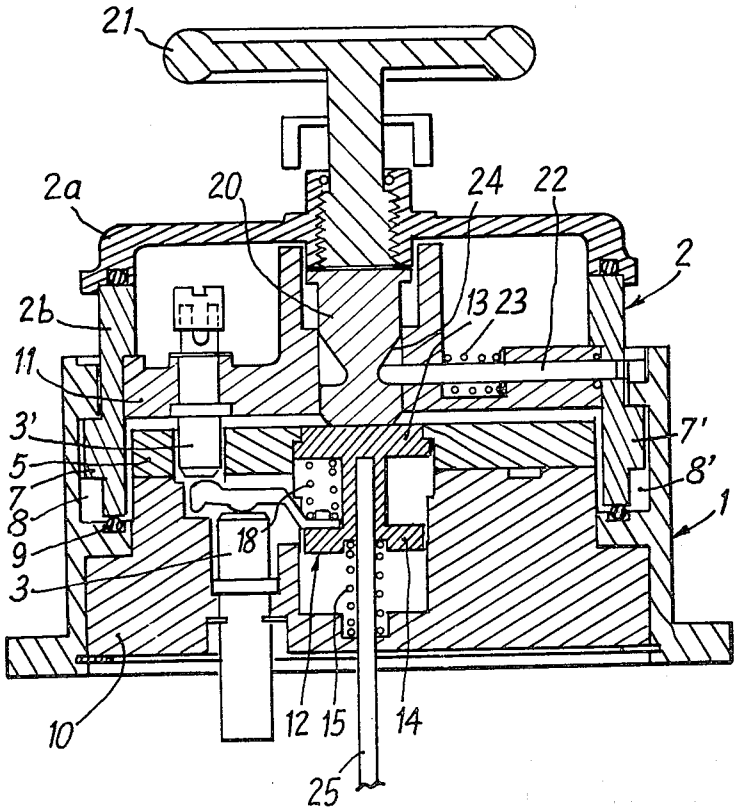
FIG. 4 illustrates the connector in the position of FIG. 3 and shows the locking device.
Figure 3:
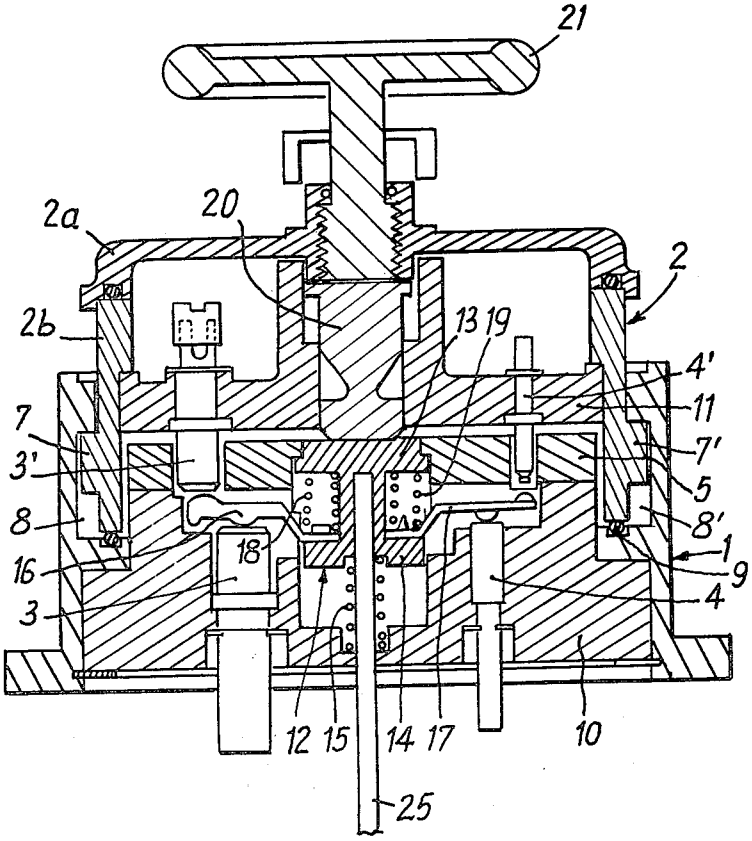
FIG. 3 shows the same connector after rotational displacement of the plug but prior to actuation of the push-rod unit.
Figure 6:
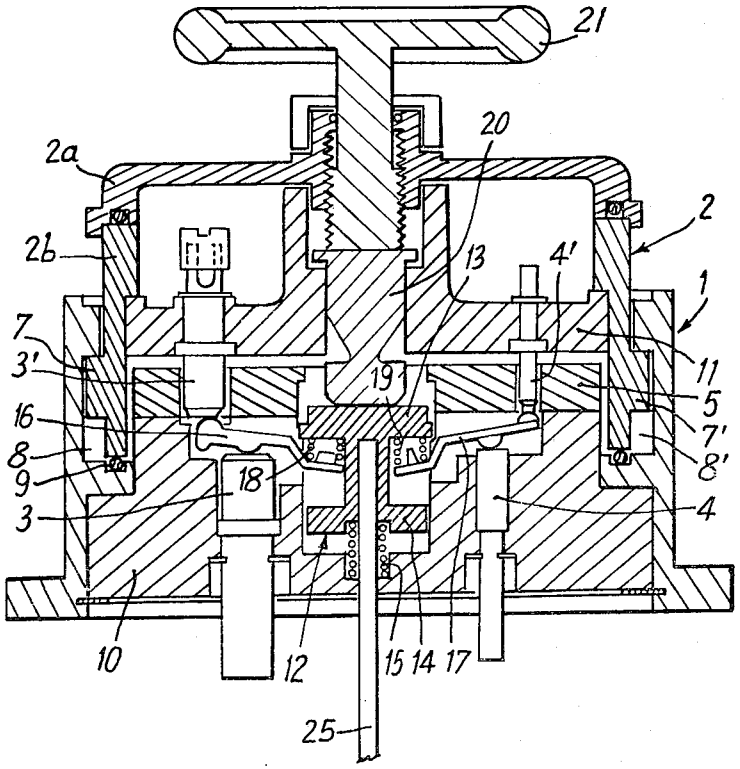
FIG. 6 corresponds to FIG. 3 after actuation of the push-rod unit.

Both the plug socket and the plug are provided with associated means for plug insertion and locking such as the lugs 7, 7' of the plug and the grooves 8, 8' of the plug socket which are provided for guiding the plug within the socket in a first movement of translation (as shown in FIG. 2), then in a movement of rotation (as shown in FIGS. 3 and 4). The plug socket is also provided with an O-ring seal 9 which could also be arranged within the plug in such a manner as to facilitate replacement of the seal, for example.

Within a central well of the insulating body 10 of the plug socket and a central opening of the safety disc 5, there is slidably mounted an element 12 formed by two discs 13, 14 which are joined together and disposed substantially at right angles to the longitudinal axis of the plug socket.

The sliding element 12 is urged by a restoring spring 15 to an inactive position (FIGS. 1 to 4) in which the disc 13 is retained by associated shouldered portions formed respectively on said disc 13 and at the periphery of the central opening of the safety disc 5 in such a manner as to ensure that the front faces of the disc 13 and of the disc 5 are substantially coplanar. The range of travel of the sliding element 12 can also be limited by a shouldered portion of the insulating body 10.

As shown in FIGS. 2 to 6, the contact-pins 3, 4 of the plug socket and the corresponding contact-pins 3', 4' of the plug are relatively displaced in the radial direction. As shown in FIGS. 3 to 6, provision is made for a contact strip 16, 17 respectively in the case of each pair of corresponding contact-pins 3, 3' and 4, 4' respectively.

The contact-strips 16, 17 of conductive material are each provided on each face with a boss or contact-stud and with an extension.

The contact-stud of one face of each contact-strip 16, 17 is adapted to rest on the end face of the corresponding contact-pin 3, 4 whilst the extensions of said contact-strips extend towards the central axis of the plug socket and are bent as shown in the drawings in such a manner as to be applied against the disc 14 of the sliding element 12 in the inactive position (as shown in FIGS. 3 and 4).

A pressure spring 18, 19 is retained between the extension of each contact-strip 16, 17 and the disc 13 of the sliding element 12. Said spring causes the corresponding contact-strip to carry out a movement of pivotal displacement while bearing on the corresponding socket contact-pin as mentioned earlier.

Within a central opening of the insulating body 11 of the plug 2, there is slidably mounted a push-rod unit 20 provided in the vicinity of the upper end with a screw-thread which is adapted to cooperate with an associated screw-thread formed in the plug component 2*a*. Provision is made for a hand-wheel 21 which is rigidly fixed to said end portion of the push-rod 20 and projects from said plug component 2*a* so that, by rotating the hand-wheel 21 in one direction or in the other, the push-rod unit 20 projects from the insulating body 11 to a greater extent or is subjected on the contrary to a movement of withdrawal.

Figure 5:
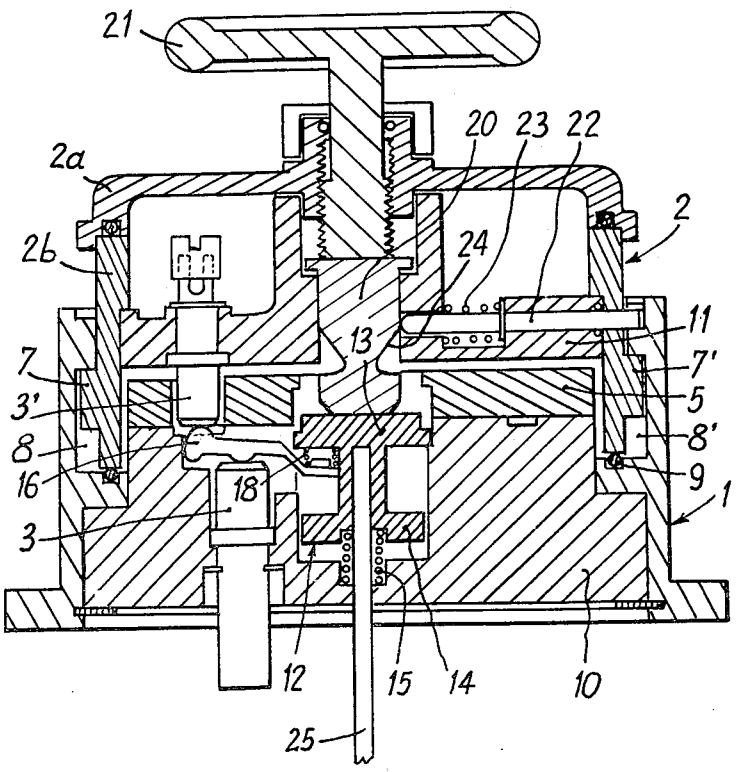
FIG. 5 corresponds to FIG. 4 after actuation of the push-rod unit.

FIGS. 4 and 5 also show by way of example a locking device comprising a rod 22 which is urged by a spring 23 to an inactive position.

One end of the rod 22 is applied against an annular groove formed in the push-rod 20 and provided with a ramp 24 as shown in FIGS. 4 and 5. The other end of said rod 22 is intended to project from the component 2*b* of the plug 2 in order to fit within a suitable recess of the plug socket in the locking position as will be explained hereinafter.

The position of the current supply connector prior to plugging-in is shown in FIG. 1. It is thus apparent that the safety disc 5 is in the locked position in which it serves to protect the socket contact-pins and that the push-rod unit 20 is in the withdrawn position.

The plug 2 is then inserted in the plug socket 1 as shown in FIG. 2, the relative angular position of the plug and of the socket being determined by the lugs 7, 7' of the plug and the grooves 8, 8' of the socket. In this position, the contact-pins of the plug are introduced within the corresponding openings of the disc 5. Moreover, the contact-pin 3' of the plug (or another element) is intended to exert a thrust on the retractable locking-lug unit 6 in order to release the safety disc 5 whilst the end of the push-rod 20 is applied against the disc 13 of the sliding element 12.

Starting from the position of FIG. 2, the plug is then rotated and the plug contact-pins thus displace the safety disc 5 to the position shown in FIGS. 3 and 4.

The movement of rotation of the plug within the socket is guided by the grooves 8, 8' and the lugs 7, 7' which also have the effect of limiting said movement and retaining the plug within the socket, thus preventing any withdrawal of the plug unless a reverse movement of rotation has previously been carried out.

In the position shown in FIGS. 3 and 4, the plug and plug socket are interlocked and the plug contact-pins 3', 4' are located opposite to the corresponding contact-studs of the contact-strips 16 and 17 respectively but are not applied against said contact-studs.

FIG. 4 also shows that the locking rod 22 is located in and inactive position, that is, a position in which it does not project from the plug 2.

In order to initiate the contact-making operation, it is then only necessary to rotate the hand-wheel 21 so as to produce a downward displacement of the sliding element 12 by screwing-down the push-rod unit 20.

During this screwing operation, the locking rod 22 is displaced by the ramp of the groove 24 and in opposition to the action of its restoring spring 23, with the result that said rod is caused to project outwards from the plug 2 and thus to interlock the plug and the plug socket (as shown in FIG. 5).

During the locking operation, the sliding element 12 moves downwards within its housing and consequently compresses its own restoring spring 15 as well as the springs 18, 19 of the contact-strips 16 and 17 which accordingly undergo a further movement of pivotal displacment while bearing on the respective socket contact-pins 3 and 4 until those contact-studs of the contact-strips which are directed towards the contact-pins 3' and 4' are applied in contact under pressure with these latter.

It will clearly be understood that the arrangement of the elements can be such that locking of the rod 22 is carried out, for example, immediately prior to initial contact-making.

Furthermore, as stated earlier, the drawings illustrate by way of example a pilot contact 4, 4'. This contact may consist, for example, of a contactor or contact-breaker control for either establishing or interrupting the connection of the plug socket to the current supply line so as to permit either making or breaking of the phase contacts under no tension.

In this case, the contact-strip 17 of the pilot contact has a shape and/or a position such that the contact-stud of the strip face which is directed towards the plug contact-pin 4' comes into contact with this latter during actuation of the push-rod unit slightly after the contact-strip 16 has been brought into contact with the contact-pin 3'.

In order to withdraw the plug 2 from the plug socket 1, it will be necessary to rotate the hand-wheel 21 in the direction of unscrewing so that the sliding element 12 should thus revert to its initial position under the action of its restoring spring 15 and the same applies to the contact-strips 16 and 17 (as shown in FIGS. 3 and 4). During this operation, the locking rod 22 also returns to its initial position under the action of the spring 23.

During this operation, the contact-strips 16 and 17 undergo a movement of pivotal displacement in the direction opposite to contact-making. Thus the contact-strip 17 moves away from the contact-pin 4' slightly before separation of the contact-strip 16 from the contact-pin 3' so as to ensure a controlled interruption of the line and thus to suppress any contact-breaking arc between the contact-pins 3' and 3. The screw-type push-rod makes it possible to obtain a fairly slow movement and therefore a sufficient length of time to obtain preliminary breaking of the pilot contact.

It is of interest to note that the plug cannot be withdrawn without first actuating the hand-wheel 21 by reason of the locking system (22, 23, 24). Similarly, it is impossible to insert the plug unless the hand-wheel 21 is in its initial position, thus ensuring perfect safety.

As can readily be understood, the end of the plug withdrawal operation is caused to take place by rotating the plug within the socket in order to revert to the position of FIG. 2 and by withdrawing the plug in order to revert to the position of FIG. 1. On completion of the above-mentioned movement of rotation, the safety disc 5 has returned to its initial position and the locking lug 6 again locks the disc 5 in position after complete withdrawal of the plug.

The drawings also show a rod 25 which is rigidly fixed to the sliding element 12 and projects from the plug socket 1. By way of example, said rod 25 constitutes a control means for actuating any device when the push-rod unit itself is actuated. The control means can consist of mechanical or electromechanical control of an auxiliary contact for such purposes, for example, as starting-up the motor of a machine or appliance which may or may not directly utilize the electric current supplied through the connector.

Moreover, said connector can be equipped with other means not shown in the drawings such as, for example, a heating resistor which is intended to prevent any condensation within the plug socket and which can be caused to cut-off by actuating the push-rod unit.

The embodiment described in the foregoing is given strictly by way of example and a large number of alternative forms or modifications may be devised without thereby departing from the scope or the spirit of the invention. It is possible in particular to conceive forms of construction in which the contact-pins of the plug and of the plug socket are substantially coaxial in the connection position, in which case the contact-strips are not necessarily provided with extensions.

It is also possible to provide a connector in accordance with the invention for any number of pairs of pins to be brought into contact and even for a single pair of contact-pins, for example (in the case of a single-wire connector). Provision may be made for a single contact-strip for each pair of contact-pins (as shown) or for a plurality of strips. Similarly, each contact-strip may be provided with a plurality of contact-studs on each face.

The drawings show one spring per contact-strip but it is clearly possible to make use of a common spring for a plurality of contact-strips or to make use of a plurality of springs for each contact-strip. In the position which immediately precedes plug insertion and rotation (as shown in FIGS. 3 and 4), certain pairs of contact-pins may already be in contact. The locking device hereinabove described could also be of a completely different type and comprise, for example, a clamping yoke controlled by the push-rod actuating means. Similarly, the push-rod unit can be provided with a handle, a lever, a push-button or the like instead of the hand-wheel, especially if the connector is not provided with any pilot contacts and therefore does not entail any need for a relatively slow or broken-down movement of the push-rod.

It is wholly possible, for example, to equip a connector of this type with a freely-sliding push-rod and with a locking hook of the type described in the afore-mentioned French Pat. No. 2,466,111 so as to permit a quick break by releasing said hook. The abrupt separation of the plug contact-pins and the contact-strips would then be obtained by withdrawal of the push-rod under the action of the spring 15 and/or another restoring means. As will readily be apparent, a constructional design of this type is more particularly applicable to lower power and lower current intensities.

A final point worthy of note is that, although the contact-strips 16, 17 do not touch the corresponding contact-pins 3', 4' of the plug and are applied against the socket contact-pins 3, 4 in the position of locking after rotation shown in FIGS. 3 and 4, it is clearly possible to conceive a form of construction in which said contact-strips do not touch any connector-pins of the plug and of the plug socket or, in contrast to the embodiment shown in the drawings, do not touch the socket contact-pins alone.

In all cases, it is understood that the above-described arrangements are merely illustrative of the many possible specific embodiments which represent applications of the present invention. Numerous and varied other arrangements can readily be devised without departing from the spirit and scope of the invention.

What we claim is:

1. A current supply connector comprising a plug socket and a detachable plug each provided with at least one stationary contact-pin to form at least one pair of pins adapted to be brought into electrical contact with each other, each pin having an end contact surface, each pair of contact-pins being provided with at least one contact-strip of conductive material, said contact-strip having two faces and being provided on each face with at least one contact-stud which is intended to be applied against the end contact surface of one of the contact-pins of said pair when the plug and plug socket are electrically connected, each contact-strip being displaced in pivotal motion by at least one spring which is wedged at one end thereof on a movable socket element to insure that each contact-stud of each contact-strip is urged towards a corresponding contact-pin and wherein the plug and plug socket are provided with means for relative locking in a position in which at least one of said contact-pins is located opposite to, but does not abut, the corresponding contact-stud of its contact-strip.

2. The connector of claim 1, wherein the socket element which retains the at least one spring, is movably mounted so as to be capable of displacement within said plug socket.

3. The connector of claim 2, further comprising means for exerting thrust on said movable socket element to increase the action of each at least one spring and thus produce increased pivotal motion of each contact-strip until each contact-stud of said contact-strip is placed in contact under pressure with a corresponding contact-pin.

4. The connector of claim 3, wherein said thrust exerting means includes a push-rod unit movably mounted within the plug, said plug including an outwardly extending hand-wheel comprising means for actuating the push-rod unit and for causing said unit to exert a thrust on the movable element.

5. A current supply connector in accordance with claim 4 in which each contact-pin of the plug is displaced radially with respect to the corresponding contact-pin of the plug socket and each contact-strip has an extension to which is secured one end of each corresponding spring so that each contact-stud of one of said contact-strip faces is applied on the end of the corresponding socket contact-pin, each contact-stud of a second of said contact-strip faces being urged towards the corresponding contact-pin of the plug, and wherein the movable socket element to which the other end of each spring is secured is slidably mounted within the plug socket, said movable socket element being urged, on the one hand, in a continuous manner towards a rest position by a resilient restoring means and, on the other hand, in response to driving action of the push-rod unit, towards a position in opposition to the action of said restoring means in which said plug and socket are connected.

6. A current supply connector in accordance with claim 5, and wherein the movable element is slidably mounted within a central well of the plug socket and each spring is a pressure spring secured between the extension of the corresponding contact-strip and a portion of the movable element so that a longitudinal displacement of said movable element in sliding motion produced by the push-rod unit subjects said spring to an additional compression.

7. A current supply connector in accordance with claim 6, and wherein the extension of each contact-strip is applied in the rest position against a portion of the movable element.

8. A current supply connector in accordance with claim 7, wherein the push-rod unit comprises a push-rod and a threaded portion cooperating with a corresponding screw-thread of the plug, and also comprising push-rod actuating means in the form of a handwheel which is rigidly fixed to the push-rod and which projects from the plug.

9. A current supply connector in accordance with claim 8, and wherein the plug is provided with means for locking said plug with respect to the plug socket, said locking means being controlled by the push-rod and the push-rod actuating means.

10. A current supply connector in accordance with claim 9, wherein the locking means comprises a rod urged to an inactive position by a restoring spring, a ramp being formed on the push-rod in order to act on a first end of the locking rod to insure that actuation of the push-rod in the contact-making direction causes a second, free end of the locking rod to project from the plug and to engage in a suitable recess of the plug socket, reverse movement of the push-rod causing unlocking of said locking rod under the action of the locking-rod restoring spring.

11. A current supply connector in accordance with claim 10, and wherein the movable element is rigidly fixed to a rod which projects from the plug socket and is intended to actuate any device when the push-rod is actuated as said rod undergoes a displacement conjointly with said movable element.

12. A current supply connector in accordance with claim 8, said connector including a ground contact having one pair of contact-pins and at least one ground contact-strip, said ground contact-strip comprising means for electrically contacting the contact-pins of said plug and of said plug socket when said push-rod unit is axially moved.

13. A current supply connector in accordance with claim 12, said connector further comprising at least one pilot contact having a pair of contact-pins and at least one pilot contact-strip, said pilot contact-strip comprising means for electrically contacting the pilot contact-pins with each other of when said push-rod unit is axially moved.

14. A current supply connector in accordance with claim 13 further comprising at least one phase contact having a pair of contact-pins and at least one contact-strip, wherein said push-rod unit comprises means for effecting electrical connection first through said ground contact, then through said phase contact, and thereafter through said pilot contact when said push-rod is axially moved.

15. A current supply connector in accordance with claim 1 wherein at least one contact-pin of said plug is located opposite to, but does not abut, a corresponding contact-stud of a contact-strip.

16. A current supply connector in accordance with claim 1 wherein at least one contact-pin of said plug socket is located opposite to, but does not abut, a corresponding contact-stud of a contact-strip.

17. A current supply connector in accordance with claim 3 wherein said contact-stud of said contact-strip is placed into contact with a corresponding contact-pin of said plug.

18. A current supply connector in accordance with claim 3 wherein said contact-stud of said contact-strip is placed into pressure contact with a corresponding contact-pin of said plug socket.

* * * * *